US008198000B2

(12) United States Patent
Jang et al.

(10) Patent No.: US 8,198,000 B2
(45) Date of Patent: Jun. 12, 2012

(54) METHOD OF PRODUCING POLYMERIZED TONER

(75) Inventors: Wook Jang, Daejeon (KR); Chang Soon Lee, Daejeon (KR)

(73) Assignee: LG Chem. Ltd., Seoul (KR)

( * ) Notice: Subject to any disclaimer, the term of this patent is extended or adjusted under 35 U.S.C. 154(b) by 0 days.

(21) Appl. No.: 12/450,889

(22) PCT Filed: Mar. 17, 2008

(86) PCT No.: PCT/KR2008/001482

§ 371 (c)(1), (2), (4) Date: Oct. 16, 2009

(87) PCT Pub. No.: WO2009/005208

PCT Pub. Date: Jan. 8, 2009

(65) Prior Publication Data

US 2010/0047708 A1 Feb. 25, 2010

(30) Foreign Application Priority Data

Jul. 5, 2007 (KR) ..... 10-2007-0067759

(51) Int. Cl.
*G03G 9/08* (2006.01)

(52) U.S. Cl. ..... 430/137.17

(58) Field of Classification Search ..... 430/137.17, 430/137.15

See application file for complete search history.

(56) References Cited

U.S. PATENT DOCUMENTS

| | | | | |
|---|---|---|---|---|
| 4,620,987 | A * | 11/1986 | Yamashita et al. | 427/131 |
| 5,227,273 | A * | 7/1993 | Yoshida et al. | 430/109.3 |
| 5,346,798 | A * | 9/1994 | Kamiyama et al. | 430/137.17 |
| 5,547,802 | A * | 8/1996 | Kawase et al. | 430/108.24 |
| 6,746,809 | B1 * | 6/2004 | Sato et al. | 430/110.2 |
| 7,128,413 | B2 * | 10/2006 | Yoshimura et al. | 347/105 |
| 2005/0250033 | A1 * | 11/2005 | Oyama et al. | 430/108.23 |
| 2006/0099530 | A1 * | 5/2006 | Lee et al. | 430/137.15 |
| 2007/0020543 | A1 * | 1/2007 | Nakatani | 430/108.4 |

FOREIGN PATENT DOCUMENTS

| | | | |
|---|---|---|---|
| JP | 2-51164 | A | 2/1990 |
| JP | 04-281466 | | 10/1992 |
| JP | 11-133658 | | 5/1999 |
| KR | 2004-0087917 | | 10/2004 |
| KR | 2005-98662 | A | 10/2005 |

* cited by examiner

*Primary Examiner* — Janis L Dote

(74) *Attorney, Agent, or Firm* — McKenna Long & Aldridge LLP

(57) ABSTRACT

A method for producing a toner is provided. The method comprises the steps of (1) dispersing a water-soluble polyvinyl alcohol having a degree of polymerization of 1,500 to 2,500 and a degree of saponification of 75 to 98% in an aqueous medium to prepare an aqueous dispersion of the polyvinyl alcohol, (2) preparing a mixture of monomers, (3) mixing the aqueous dispersion with the monomer mixture, and (4) polymerizing the monomers.

8 Claims, No Drawings

METHOD OF PRODUCING POLYMERIZED TONER

This application is a National Stage Entry of International Application No. PCT/KR2008/001482, filed Mar. 17, 2008, and claims priority to Korean Patent Application No. 10-2007-0067759, filed in Korea on Jul. 5, 2007.

TECHNICAL FIELD

The present invention relates to a method for producing a polymerized toner, and more specifically to a method for producing a polymerized toner, characterized in that a water-soluble polyvinyl alcohol is dispersed in an aqueous medium to prepare an aqueous dispersion of the polyvinyl alcohol.

BACKGROUND ART

Toners are used for the development of electrophotographic images and in a variety of electrostatic printing and copying apparatuses. Toners refer to coating substances that can be transferred and fixed to objects to form desired patterns thereon. As computer-aided documentation has been generalized in recent years, there has been a rapidly increasing demand for imaging apparatuses, such as printers. In response to this demand, the use of toners is also on the rise.

Methods for the production of toners are largely classified into two types of methods based on pulverization and polymerization. The first type of methods based on pulverization is most widely known. According to a typical method based on pulverization, a resin and a pigment is melt-mixed or extruded, pulverized and sorted on the basis of size to obtain toner particles. However, the toner particles have a broad particle diameter distribution and are very irregular in shape (e.g., sharp edges), which are disadvantageous in terms of charge properties and flowability.

To overcome the above disadvantages of the first type of methods, the second type of methods based on polymerization for the production of spherical toner particles has been proposed. It is known that the second type of methods can be carried out by emulsion polymerization/aggregation and suspension polymerization. According to emulsion polymerization, however, the size distribution of particles is difficult to control and the reproducibility of toner quality remains problematic. For these reasons, suspension polymerization is predominantly employed in preference to emulsion polymerization.

However, toner particles produced by suspension polymerization also have a broad size distribution, which necessitates an additional separation step. Further, a toner having undergone size separation is consumed in a large amount during printing and is unsatisfactory in terms of transferability.

DISCLOSURE

Technical Problem

The present invention has been made in view of the above problems, and it is an object of the present invention to provide a method for producing a polymerized toner that has a preferable volume average particle diameter, has a narrow particle size distribution, is consumed in a small amount during printing and is transferred at a high rate.

Technical Solution

In order to accomplish the object of the present invention, there is provided a method for producing a toner whose volume average particle diameter (dv) is between 5 and 10 μm and the ratio dv/dp, i.e. volume average particle diameter (dv)/number average particle diameter (dp), is not larger than 1.5, the method being characterized by the addition of a water-soluble polyvinyl alcohol having a degree of polymerization and a degree of saponification in particular ranges to an aqueous medium to prepare an aqueous dispersion of the polyvinyl alcohol.

Specifically, the method of the present invention comprises the following steps:

(1) dispersing a water-soluble polyvinyl alcohol having a degree of polymerization of 1,500 to 2,500 and a degree of saponification of 75 to 98% in an aqueous medium to prepare an aqueous dispersion of the polyvinyl alcohol;

(2) preparing a mixture of monomers;

(3) mixing the aqueous dispersion with the monomer mixture; and (4) polymerizing the monomers.

Advantageous Effects

According to the method of the present invention, a water-soluble polyvinyl alcohol having a degree of polymerization and a degree of saponification in particular ranges is added to an aqueous medium to prepare an aqueous dispersion of the polyvinyl alcohol, and particular monomers are subjected to suspension polymerization to produce a polymerized toner whose volume average particle diameter (dv) is between 5 and 10 μm and the ratio dv/dp is not greater than 1.5.

BEST MODE FOR CARRYING OUT THE INVENTION

The present invention will now be described in detail.

The present invention provides a method for producing a toner, comprising the steps of dispersing a water-soluble polyvinyl alcohol having a degree of polymerization of 1,500 to 2,500 and a degree of saponification of 75 to 98% in an aqueous medium to prepare an aqueous dispersion of the polyvinyl alcohol, preparing a mixture of monomers, mixing the aqueous dispersion with the monomer mixture, and polymerizing the monomers.

In an embodiment, the polymerization is carried out by suspension polymerization as follows.

(1) Preparation of Polymerized Toner

A water-soluble polyvinyl alcohol (PVA) is added to an aqueous medium to prepare an aqueous dispersion of the polyvinyl alcohol. At this time, the polyvinyl alcohol is added in an amount of 1 to 10 parts by weight, based on 100 parts by weight of the aqueous dispersion.

Examples of monomers suitable for use in the present invention include aromatic vinyl monomers, acrylate monomers, methacrylate monomers, diene monomers, and mixtures thereof. Optionally, an acidic or basic olefin monomer may be added to the monomer mixture.

Specifically, the monomer mixture includes 30 to 95 parts by weight of an aromatic vinyl monomer, 5 to 70 parts by weight of at least one monomer selected from the group consisting of acrylate, methacrylate and diene monomers, optionally 0.1 to 30 parts by weight of an acidic or basic olefin monomer, 1 to 20 parts by weight of a pigment, 0.1 to 30 parts by weight of a wax, 0.001 to 10 parts by weight of a crosslinking agent, 0.1 to 20 parts by weight of a charge control agent, and 0.001 to 8 parts by weight of a molecular weight modifier, based on the total weight of all monomers used.

1 to 60 parts by weight of the monomer mixture is mixed with 100 parts by weight of the aqueous dispersion to obtain a mixed solution in order to include 0.1 to 20 parts by weight of the above polyvinyl alcohol based on the total weight of all monomers used.

Polymerization is carried out while applying a shear force to the mixed solution using a homogenizer to prepare toner cores.

If required, 0.01 to 10 parts by weight of at least one polar polymer selected from polyesters and styrene-acrylate polymers, based on 100 parts by weight of the monomer mixture without the polar polymer, may be added to the monomer mixture.

As the aromatic vinyl monomer, there may be used, for example, styrene, monochlorostyrene, methylstyrene or dimethylstyrene. The aromatic vinyl monomer is preferably used in an amount of 30 to 95 parts by weight, based on the total weight of all monomers used.

As the acrylate monomer, there may be used, for example, methyl acrylate, ethyl acrylate, n-butyl acrylate, isobutyl acrylate, dodecyl acrylate or 2-ethylhexyl acrylate. As the methacrylate monomer, there may be used, for example, methyl methacrylate, ethyl methacrylate, n-butyl methacrylate, isobutyl methacrylate, dodecyl methacrylate or 2-ethylhexyl methacrylate. As the diene monomer, there may be used, for example, butadiene or isoprene.

At least one monomer selected from the acrylate, methacrylate and diene monomers is preferably used in an amount of 5 to 70 parts by weight, based on the total weight of all monomers used.

As the acidic olefin monomer, for example, an α,β-ethylenically unsaturated compound having at least one carboxyl group may be used. As the basic olefin monomer, there may be used, for example, a methacrylic acid ester, a methacrylamide, a vinylamine or a diallylamine of an aliphatic alcohol having at least one group selected from amine and quaternary ammonium groups, or an ammonium salt thereof. It is preferable to use at least one olefin monomer selected from the acidic and basic olefin monomers in an amount of 0.1 to 30 parts by weight, based on the total weight of all monomers used.

The wax may be selected from: petroleum waxes, such as paraffin wax, microcrystalline wax and ceresin wax; natural waxes, such as carnauba wax; synthetic waxes, such as ester wax, polyethylene wax and polypropylene wax; and mixtures thereof. It is preferable to use the wax in an amount of 0.1 to 30 parts by weight, based on the total weight of all monomers used.

The molecular weight modifier may be selected from mercaptan compounds, such as t-dodecyl mercaptan and n-dodecyl mercaptan, and mixtures thereof. It is preferable to use the molecular weight modifier in an amount of 0.001 to 8.000 parts by weight, based on the total weight of all monomers used.

As the pigment, there may be used: an inorganic pigment selected from metal powder, metal oxide, carbon, sulfide, chromate and ferrocyanide pigments; an organic pigment selected from azo dye, acidic dye, basic dye, mordant dye, phthalocyanine, quinacridone and dioxane pigments; or a mixture thereof. It is preferable to use the pigment in an amount of 1 to 20 parts by weight, based on the total weight of all monomers used.

As the charge control agent, there may be used: a cationic charge control agent, such as a nigrosine type acidic dye, a higher aliphatic metal salt, an alkoxyamine, a chelate, a quaternary ammonium salt, an alkylamide, a fluorine-treated activator or a naphthenic acid metal salt; an anionic charge control agent, such as an acidic organic complex, chlorinated paraffin, a chlorinated polyester, a sulfonylamine of copper phthalocyanine or a styrene-acrylate polymer having sulfonic acid groups; or a mixture thereof. It is preferable to use the charge control agent in an amount of 0.1 to 20 parts by weight, based on the total weight of all monomers used.

As the crosslinking agent, there may be used, for example, divinylbenzene, ethylene dimethacrylate, ethylene glycol dimethacrylate, diethylene glycol diacrylate, 1,6-hexamethylene diacrylate, allyl methacrylate, 1,1,1-trimethylolpropane triacrylate, triallylamine or tetraallyloxyethane. It is preferable to use the crosslinking agent in an amount of 0.001 to 10 parts by weight, based on the total weight of all monomers used.

The monomer mixture may further include 0.01 to 5 parts by weight of a reaction initiator, based on the total weight of all monomers used. An oil-soluble or water-soluble initiator can be used as the reaction initiator. Specific examples of suitable reaction initiators include azo initiators, such as azobisisobutyronitrile and azobisvaleronitrile; organic peroxides, such as benzoyl peroxide and lauroyl peroxide; and generally used water-soluble initiators, such as potassium persulfate and ammonium persulfate. The reaction initiator is preferably used in an amount of 0.01 to 5.00 parts by weight and more preferably 0.1 to 2.0 parts by weight, based on the total weight of all monomers used.

The water-soluble polyvinyl alcohol (PVA) has a degree of polymerization of 1,500 to 2,500 and preferably 1,700 to 2,100. The water-soluble polyvinyl alcohol (PVA) has a degree of saponification of 75 to 98% and preferably 85 to 95%. If the degree of polymerization of the polyvinyl alcohol is lower than 1,500, it is difficult to sufficiently disperse the monomer mixture in the aqueous dispersion. Meanwhile, if the degree of polymerization of the polyvinyl alcohol is greater than 2,500, the solubility of the polyvinyl alcohol in the aqueous medium is lowered, making it difficult to render the aqueous dispersion homogeneous. If the degree of saponification of the polyvinyl alcohol is less than 75%, the polyvinyl alcohol is less soluble with increasing temperatures (60° C. and 90° C.) to precipitate in the aqueous medium, making it impossible to properly disperse the monomer mixture in the aqueous dispersion. Meanwhile, if the degree of saponification of the polyvinyl alcohol exceeds 98%, the hydrophilicity of the polyvinyl alcohol increases, resulting in a deterioration in the performance of the polyvinyl alcohol as a dispersant.

(2) Removal of Polyvinyl Alcohol (PVA)

The polyvinyl alcohol (PVA) is separated from the solution containing the polymerized toner by a suitable method. First, the aqueous dispersion containing the polyvinyl alcohol (PVA) and the polymerized toner is diluted with distilled water. At this time, the amount of the distilled water used is two times larger than that of the aqueous dispersion. A homogenizer is used to apply a shear force to the dilute aqueous solution, followed by separation and cleaning using suitable equipment, such as a filter, a filter press, a general centrifuge or a continuous decanter type high-speed centrifuge, to separate the polyvinyl alcohol from the toner.

MODE FOR INVENTION

Hereinafter, the present invention will be explained in more detail with reference to the following examples. However, these examples are provided to assist in a further understanding of the invention and for illustrative purposes, and are not intended to limit the scope of the present invention.

EXAMPLES

Example 1

Production of Polymerized Toner

To 400 parts by weight of ion-exchange water was added 5 parts by weight of a water-soluble polyvinyl alcohol (degree of polymerization: 1,700, degree of saponification: 90%) as a dispersant. The mixture was stirred at room temperature for 10 minutes, heated to a reaction temperature of 70° C., and further stirred for 20 minutes to prepare an aqueous dispersion.

4 parts by weight of allyl methacrylate as a crosslinking agent and 0.02 g of n-dodecyl mercaptan as a molecular weight modifier were added to a mixture of 160 parts by weight of styrene, 36 parts by weight of n-butyl acrylate and 4 parts by weight of acrylic acid as monomers. One part by weight of a styrene-acrylic polymer having sulfonic acid groups as a charge control agent was sufficiently dissolved in the monomer mixture, and 10 parts by weight of carbon black was added thereto. After the resulting mixture was stirred in a bead mill at 2,000 rpm for 2 hours, beads were removed to prepare 215 parts by weight of a mixture of the monomers and the pigment.

The monomer mixture was mixed with the aqueous dispersion to obtain a mixed solution. The mixed solution was heated to 70° C. in a water bath, and 5 parts by weight of paraffin wax was added thereto. The resulting mixture was allowed to react with stirring for 20 minutes. The reaction was continued while stirring using a paddle stirrer at 600 rpm for 15 hours to obtain a polymerized toner.

(Centrifugal Cleaning)

The aqueous dispersion containing the polyvinyl alcohol (PVA) and the polymerized toner was diluted with a two-fold amount of distilled water. A homogenizer was used to apply a shear force to the dilute aqueous solution, followed by centrifugation in a centrifuge (Beckman J2-21M, Rotor JA-14) at 3,000 rpm for 15 minutes to obtain a concentrate containing the polymerized toner. The concentrate was diluted with a two-fold amount of distilled water. A homogenizer was used to apply a shear force to the dilute aqueous solution, followed by centrifugation in a centrifuge (Beckman J2-21M, Rotor JA-14) at 3,000 rpm for 15 minutes. The above procedure was further repeated twice to remove the polyvinyl alcohol (PVA) from the toner surface. Filtration was conducted to remove moisture, leaving a toner cake. The toner cake was dried in a vacuum oven at room temperature for 48 hours to produce a toner.

(Size and Shape of Toner Particles)

A Multisizer Coulter Counter and a scanning electron microscope (SEM) were used to observe and measure the size and shape of the toner particles.

(Surface Treatment of Toner Particles)

Two parts by weight of silica having a size of 15 nm was added to 100 parts by weight of the toner particles and stirred using a Henschel coater at a high rate of 5,000 rpm for 7 minutes to adsorb the silica on the surface of the toner particles.

(Consumed Amount and Transfer Rate of Toner)

The surface-treated toner was filled in a toner feeder of a printer cartridge (HP4600 Printer, Hewlett-Packard). The toner feeder filled with the toner was weighed before printing. Rectangles of 19 cm (w)×1.5 cm (h) were printed on 1,000 sheets of paper (A4 size). The toner feeder was weighed after printing. The amount of the toner consumed was calculated by the following equation:

$$\text{Amount of toner consumed (g)} = \text{Weight of toner feeder before printing} - \text{Weight of toner feeder after printing on 1,000 sheets of paper}$$

The weight of a drum separable from the toner feeder was measured before and after printing. The amount of the toner wasted without being transferred to the paper was calculated by the following equation:

$$\text{Amount of toner wasted (g)} = \text{Weight of drum after printing on 1,000 sheets of paper} - \text{Weight of drum before printing}$$

From the amount of the toner consumed and the amount of the toner wasted, the transfer rate of the toner was calculated by the following equation:

$$\text{Transfer rate of toner (\%)} = \frac{\text{Amount of toner consumed} - \text{Amount of toner wasted}}{\text{Amount of toner consumed}} \times 100$$

The results are shown in Table 1.

Example 2

A polymerized toner was produced in the same manner as in Example 1 except that a polyvinyl alcohol having a degree of polymerization of 1,900 and a degree of saponification of 90% was added to the aqueous dispersion medium. The results are shown in Table 1.

Example 3

A polymerized toner was produced in the same manner as in Example 1 except that a polyvinyl alcohol having a degree of polymerization of 2,100 and a degree of saponification of 90% was added to the aqueous dispersion medium. The results are shown in Table 1.

Example 4

A polymerized toner was produced in the same manner as in Example 1 except that a polyvinyl alcohol having a degree of polymerization of 1,700 and a degree of saponification of 85% was added to the aqueous dispersion medium. The results are shown in Table 1.

Example 5

A polymerized toner was produced in the same manner as in Example 1 except that a polyvinyl alcohol having a degree of polymerization of 2,100 and a degree of saponification of 85% was added to the aqueous dispersion medium. The results are shown in Table 1.

Comparative Example 1

A polymerized toner was produced in the same manner as in Example 1 except that no polyvinyl alcohol was added to the aqueous dispersion medium. The results are shown in Table 1.

Comparative Example 2

A polymerized toner was produced in the same manner as in Example 1 except that a polyvinyl alcohol having a degree of polymerization of 2,000 and a degree of saponification of 99% was added to the aqueous dispersion medium. The results are shown in Table 1.

Comparative Example 3

A polymerized toner was produced in the same manner as in Example 1 except that a polyvinyl alcohol having a degree of polymerization of 1,200 and a degree of saponification of 90% was added to the aqueous dispersion medium. The results are shown in Table 1.

Comparative Example 4

A polymerized toner was produced in the same manner as in Example 1 except that a polyvinyl alcohol having a degree of polymerization of 3,000 and a degree of saponification of 90% was added to the aqueous dispersion medium. The results are shown in Table 1.

Comparative Example 5

A polymerized toner was produced in the same manner as in Example 1 except that a polyvinyl alcohol having a degree of polymerization of 1,7000 and a degree of saponification of 70% was added to the aqueous dispersion medium. The results are shown in Table 1.

TABLE 1

| | Degree of polymerization of PVA | Degree of saponification (%) of PVA | dv[1)] | dv/dp[2)] | Amount of toner consumed (g) | Transfer rate of toner (%) |
|---|---|---|---|---|---|---|
| Example 1 | 1,700 | 90 | 7.5 | 1.4 | 17 | 97 |
| Example 2 | 1,900 | 90 | 7.8 | 1.3 | 19 | 98 |
| Example 3 | 2,100 | 90 | 8.1 | 1.2 | 20 | 98 |
| Example 4 | 1,700 | 85 | 7.1 | 1.4 | 18 | 97 |
| Example 5 | 2,100 | 85 | 7.3 | 1.3 | 17 | 96 |
| Comparative Example 1 | — | — | 6.7 | 1.8 | 25 | 90 |
| Comparative Example 2 | 2,000 | 99 | — | — | — | — |
| Comparative Example 3 | 1,200 | 90 | 6.5 | 1.7 | 26 | 88 |
| Comparative Example 4 | 3,000 | 90 | 7.9 | 1.4 | 23 | 93 |
| Comparative Example 5 | 1,700 | 70 | 4.8 | 1.7 | 20 | 85 |

Note.
dv[1)]: Volume average particle diameter
dv/dp[2)]: Volume average particle diameter (dv)/Number average particle diameter (dp)

The invention claimed is:

1. A method for producing a toner having a volume average particle diameter (dv) between 7.3 and 8.1 μm and a ratio of volume average particle diameter (dv)/number average particle diameter (dp) not larger than 1.3, the method comprising the steps of:

(1) dispersing a water-soluble polyvinyl alcohol having a degree of polymerization of 1,900 to 2,100 and a degree of saponification of 85 to 95% in an aqueous medium to prepare an aqueous dispersion comprising 1 to 10 parts by weight of the polyvinyl alcohol based on 100 parts by weight of the aqueous dispersion;

(2) preparing a mixture of monomers;

(3) mixing the aqueous dispersion with the monomer mixture in order to include 0.1 to 20 parts by weight of the above polyvinyl alcohol based on the total weight of all monomers used;

(4) suspension polymerizing the monomers while applying a shear force to the mixed solution of the above aqueous dispersion and the above monomer mixture using a homogenizer; and (5) removing the above polyvinyl alcohol, wherein 1 to 60 parts by weight of the monomer mixture is mixed with 100 parts by weight of the aqueous dispersion, the monomer mixture includes 30 to 95 parts by weight of an aromatic vinyl monomer based on 100 parts by weight of all monomers used;

5 to 70 parts by weight of at least one monomer selected from the group consisting of acrylate, methacrylate and diene monomers based on 100 parts by weight of all monomers used;

1 to 20 parts by weight of a pigment based on 100 parts by weight of all monomers used;

0.1 to 30 parts by weight of a wax based on 100 parts by weight of all monomers used;

0.001 to 10 parts by weight of a crosslinking agent based on 100 parts by weight of all monomers used;

0.1 to 20 parts by weight of a charge control agent based on 100 parts by weight of all monomers used;

0.001 to 8 parts by weight of a molecular weight modifier based on 100 parts by weight of all monomers used;

wherein the monomer mixture further includes 0.01 to 10 parts by weight of at least one polar polymer selected from the group consisting of polyesters and styrene-acrylate polymers, based on 100 parts by weight of the monomer mixture without the polar polymer, and wherein the monomer mixture further includes 0.1 to 30 parts by weight of an acidic or basic olefin monomer, based on 100 parts by weight of all monomers used.

2. The method according to claim 1, wherein the aromatic vinyl monomer is selected from the group consisting of styrene, monochlorostyrene, methylstyrene and dimethylstyrene.

3. The method according to claim 1, wherein the acrylate monomer is selected from the group consisting of methyl acrylate, ethyl acrylate, n-butyl acrylate, isobutyl acrylate, dodecyl acrylate and 2-ethylhexyl acrylate; the methacrylate monomer is selected from the group consisting of methyl methacrylate, ethyl methacrylate, n-butyl methacrylate, isobutyl methacrylate, dodecyl methacrylate and 2-ethylhexyl methacrylate; and the diene monomer is selected from the group consisting of butadiene and isoprene.

4. The method according to claim 1, wherein the wax is selected from the group consisting of paraffin wax, microcrystalline wax, ceresin wax, carnauba wax, ester wax, polyethylene wax, polypropylene wax, and mixtures thereof.

5. The method according to claim 1, wherein the molecular weight modifier is selected from the group consisting of t-dodecyl mercaptan, n-dodecyl mercaptan, and mixtures thereof.

6. The method according to claim 1, wherein the pigment is selected from the group consisting of: metal powder, metal oxide, carbon, sulfide, chromate, ferrocyanide pigments, azo dye, acidic dye, basic dye, mordant dye, phthalocyanine, quinacridone, dioxane pigments, and mixtures thereof.

7. The method according to claim 1, wherein the charge control agent is: a cationic charge control agent selected from the group consisting of nigrosine acidic dyes, higher aliphatic metal salts, alkoxyamines, chelates, quaternary ammonium salts, alkylamides, fluorine-treated activators and naphthenic acid metal salts; an anionic charge control agent selected from the group consisting of acidic organic complexes, chlorinated paraffin, chlorinated polyesters, sulfonylamines of copper phthalocyanine and styrene-acrylate polymers having sulfonic acid groups; or a mixture thereof.

8. The method according to claim 1, wherein the crosslinking agent is selected from the group consisting of divinylbenzene, ethylene dimethacrylate, ethylene glycol dimethacrylate, diethylene glycol diacrylate, 1,6-hexamethylene diacrylate, allyl methacrylate, 1,1,1-trimethylolpropane triacrylate, triallylamine, and tetraallyloxyethane.

* * * * *